US007578758B2

(12) United States Patent
Thomas

(10) Patent No.: US 7,578,758 B2
(45) **Date of Patent: *Aug. 25, 2009**

(54) BUNTING BAT

(76) Inventor: Mark A. Thomas, 3150 W. 215th St., Bucyrus, KS (US) 66013

( * ) Notice: Subject to any disclaimer, the term of this patent is extended or adjusted under 35 U.S.C. 154(b) by 0 days.

This patent is subject to a terminal disclaimer.

(21) Appl. No.: 11/868,666

(22) Filed: Oct. 8, 2007

(65) Prior Publication Data

US 2008/0026878 A1 Jan. 31, 2008

Related U.S. Application Data

(63) Continuation of application No. 11/388,147, filed on Mar. 23, 2006, now Pat. No. 7,331,885.

(51) Int. Cl.
*A63B 59/06* (2006.01)
*A63B 69/00* (2006.01)

(52) U.S. Cl. ..... 473/564; 473/457

(58) Field of Classification Search ..... 473/457, 473/519, 520, 564–568
See application file for complete search history.

(56) References Cited

U.S. PATENT DOCUMENTS

| | | | | |
|---|---|---|---|---|
| 748,000 | A | 12/1903 | Murnane | |
| 2,091,458 | A | 8/1937 | Sleight | |
| 3,469,839 | A | 9/1969 | Pietronuto et al. | |
| 4,930,772 | A | 6/1990 | Maloney et al. | |
| 5,245,228 | A | 9/1993 | Hope, II | |
| D341,178 | S | 11/1993 | Rice et al. | |
| D351,868 | S | 10/1994 | Pendergast | |
| 5,711,728 | A | 1/1998 | Marcelo | |
| 5,839,983 | A | 11/1998 | Kramer | |
| D406,624 | S | 3/1999 | Kennedy et al. | |
| 6,048,283 | A | 4/2000 | Albarelli, Jr. | |
| 6,146,291 | A | 11/2000 | Nydigger | |
| 6,149,539 | A | 11/2000 | DeMarini | |
| 6,186,909 | B1 | 2/2001 | Sanson, Jr. | |
| 6,305,051 | B1 * | 10/2001 | Cho | 16/430 |
| 6,669,584 | B1 | 12/2003 | Miller | |
| 7,331,885 | B2 * | 2/2008 | Thomas | 473/564 |

(Continued)

OTHER PUBLICATIONS

Office Action dated Apr. 19, 2007 cited in related U.S. Appl. No. 11/388,147.

(Continued)

*Primary Examiner*—Mark S Graham
(74) *Attorney, Agent, or Firm*—Lathrop & Gage LLP

(57) ABSTRACT

Bats that aid in bunting are disclosed herein. The bats generally include a rounded elongate shaft having a handle end and a contact end, and the handle end may have a diameter that is smaller than a diameter of the contact end. In an embodiment, at least one indicator is between the handle and contact ends to designate where and how a user should hold the bat while bunting. In an embodiment, first and second indentations are in a surface of the shaft between the handle and contact ends to designate where a user should hold the bat while bunting. In an embodiment, at least one indicator selected from the group consisting of an indentation, a marking, and a bump is between the handle and contact ends to designate where and how a user should hold the bat while bunting.

10 Claims, 5 Drawing Sheets

U.S. PATENT DOCUMENTS

| | | | |
|---|---|---|---|
| 2003/0134698 | A1 | 7/2003 | Clark et al. |
| 2004/0194521 | A1 | 10/2004 | Andrews |
| 2005/0202910 | A1 | 9/2005 | Blount |
| 2006/0276275 | A1 | 12/2006 | Guenther et al. |

OTHER PUBLICATIONS

Response to Office Action dated Apr. 19, 2007 in related U.S. Appl. No. 11/388,147, filed on Jun. 28, 2007.

Office Action dated Jul. 31, 2007 cited in related U.S. Appl. No. 11/388,147.

Response to Office Action dated Jul. 31, 2007 in related U.S. Appl. No. 11/388,147 filed on Oct. 8, 2007.

Notice of Allowance and Fees Due dated Oct. 22, 2007, in related U.S. Appl. No. 11/388,147.

* cited by examiner

BUNTING BAT

RELATED APPLICATION

This application claims benefit and is a continuation of U.S. patent application Ser. No. 11/388,147, filed Mar. 23, 2006, now U.S. Pat. No. 7,331,885 the disclosure of which is incorporated herein by reference.

BACKGROUND

Many skills are required to play the game of baseball and games similar to baseball, such as softball. Though many of these skills are not intuitive, they can usually be learned. One of the harder skills to teach and learn has heretofore been "bunting", which involves tapping a ball lightly with a bat so that the ball rolls slowly in front of infielders. Bunting has been difficult to teach and learn because, among other reasons, 1) players have difficulty in holding the bat correctly; and 2) players are often pinched by the bat when it strikes the ball if the bat is held incorrectly.

While many instructional materials and prior art devices address bunting, there has not previously been a bat that aids in bunting by teaching and denoting a proper manner of holding the bat while bunting.

SUMMARY

A bat that aids in bunting and especially in learning to bunt would aid players in becoming well-rounded hitters and bunting without being pinched by the bat. Accordingly, bats that aid in bunting are disclosed herein. A bat of one embodiment includes a rounded elongate shaft having a handle end and a contact end. The handle end has a diameter that is smaller than a diameter of the contact end, and at least one indicator is between the handle and contact ends to designate where and how a user should hold the bat while bunting.

In an embodiment, a bat includes a rounded elongate shaft having a handle end and a contact end and presenting a surface. The handle end has a diameter that is smaller than a diameter of the contact end. First and second indentations are in the surface of the elongate shaft between the handle and contact ends to designate where a user should hold the bat while bunting.

In an embodiment, a bat includes a rounded elongate shaft having a handle end and a contact end. The handle end has a diameter that is smaller than a diameter of the contact end, and at least one indicator is between the handle and contact ends to designate where and how a user should hold the bat while bunting. The at least one indicator is selected from the group consisting of an indentation, a marking, and a bump.

DETAILED DESCRIPTION

Figure 1:
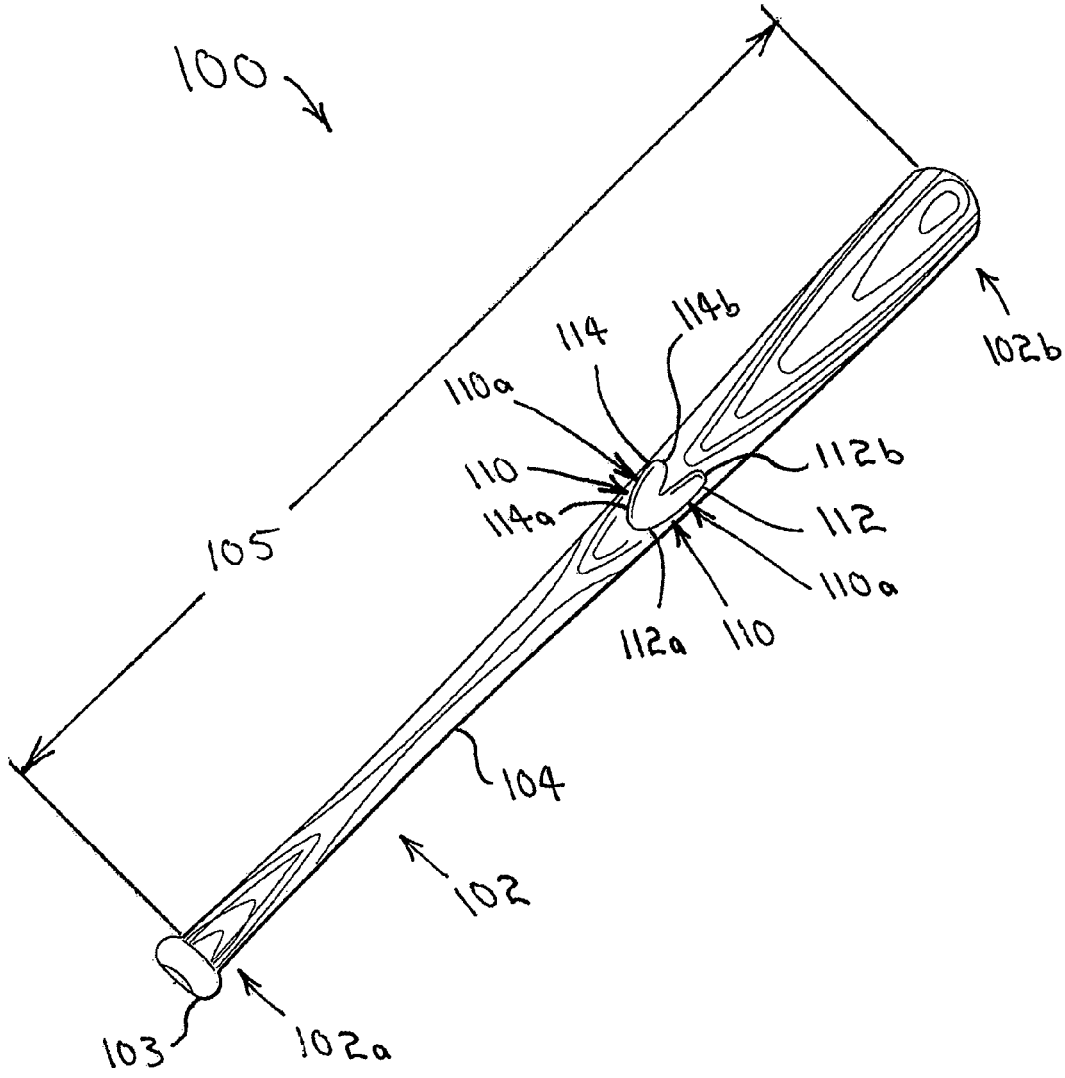
FIG. 1 shows a bunting bat in accord with an embodiment.
Figure 5:
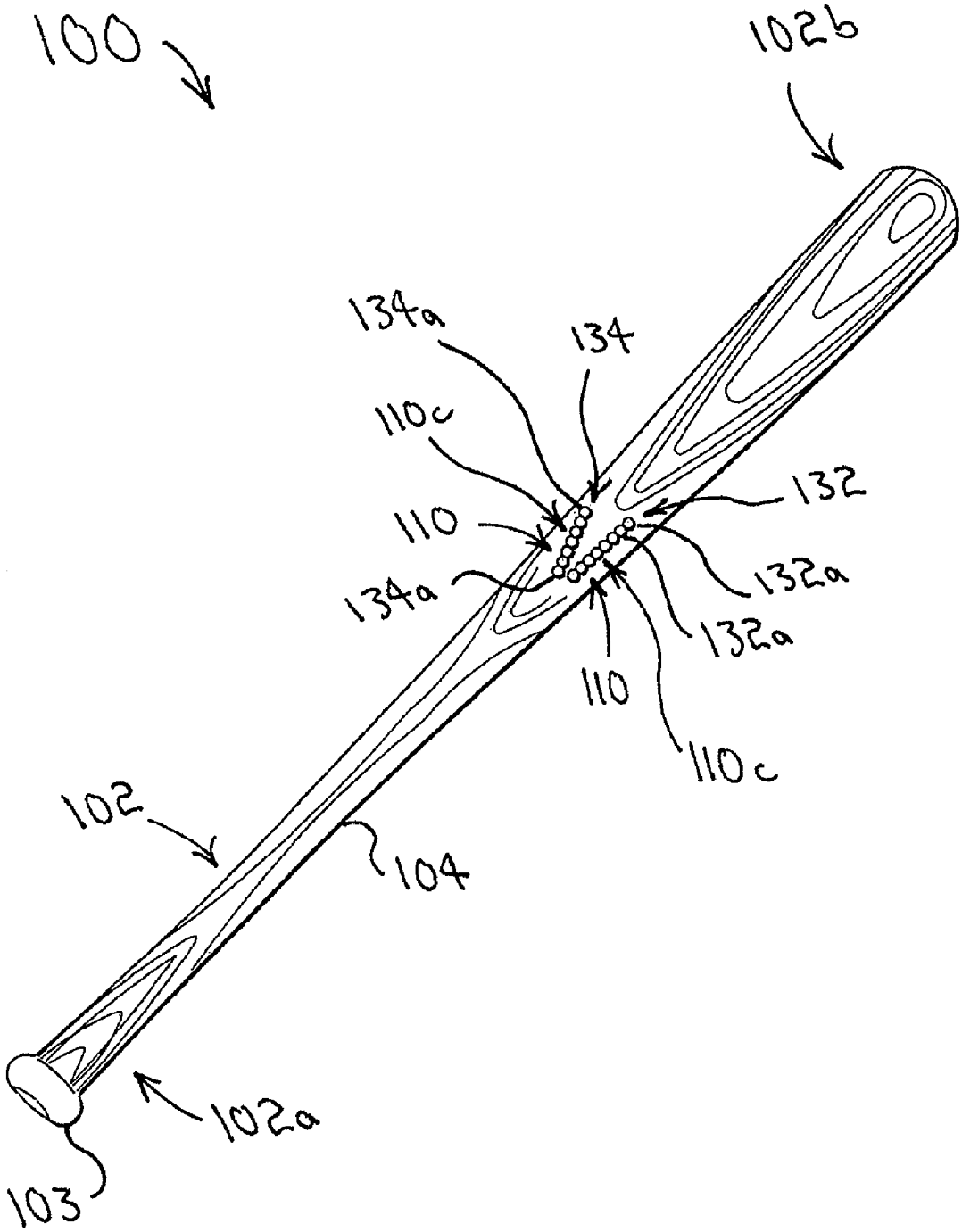
FIG. 5 shows a bunting bat having bumps.
Figure 6:
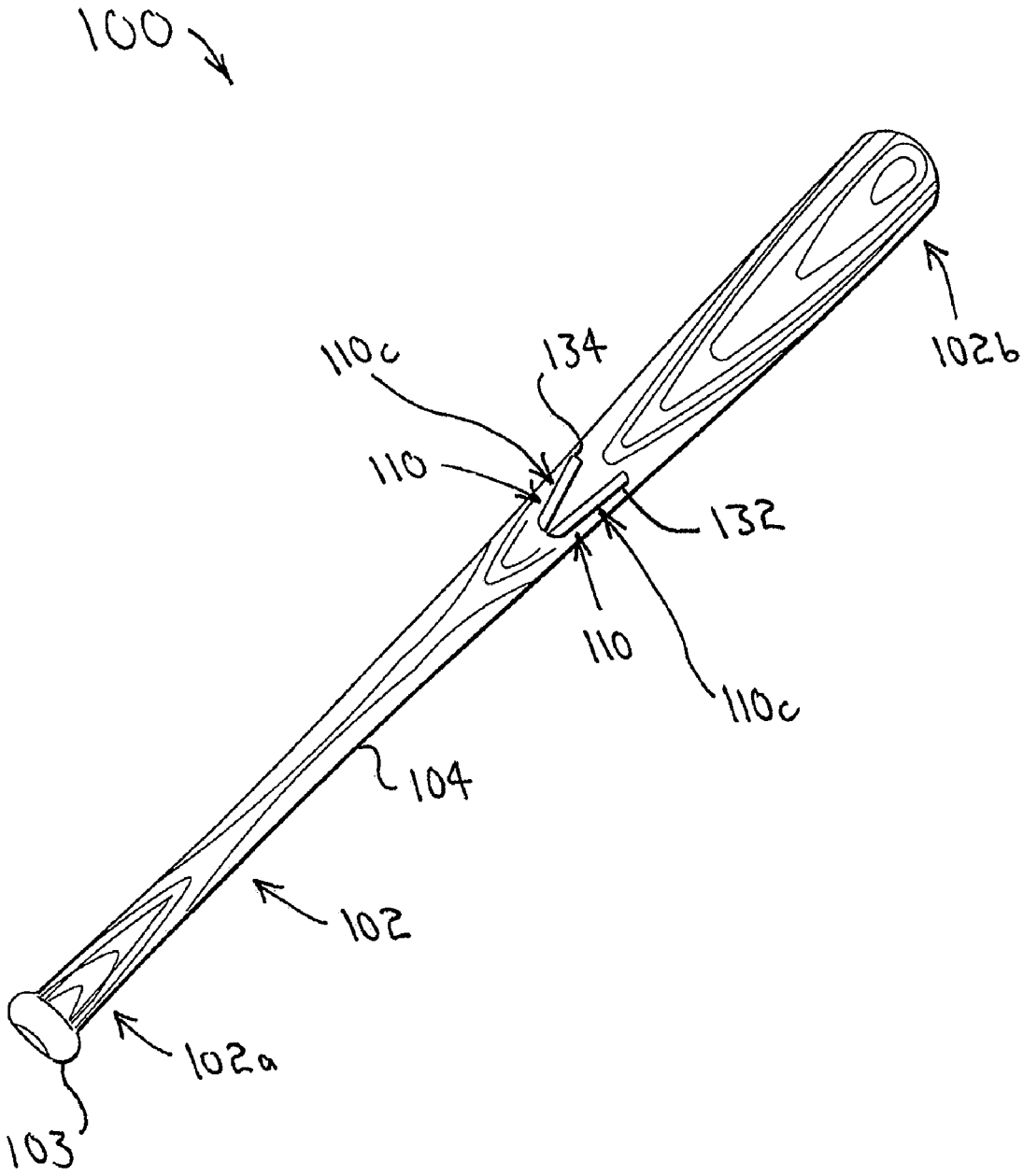
FIG. 6 shows a bunting bat having bumps in accord with another embodiment.

FIG. 1 shows a bat 100 according to one embodiment. The bat 100 includes a rounded elongate shaft 102 having a handle end 102*a* and a contact end 102*b* and presenting a surface 104 and a length 105. A knob 103 is at the handle end 102*a* to allow a user to retain control of the bat 100, as is known in the art. The elongate shaft 102 may be made of wood, metal, plastic, composite, and/or another material. The handle end 102*a* has a diameter that is smaller than a diameter of the contact end 102*b*, and the bat 100 includes at least one indicator 110 between the handle and contact ends 102*a*, 102*b* to designate where and how a user should hold the bat 100 while bunting. The indicator(s) 110 may include, for example, indentations 110*a* in surface 104 (FIGS. 1-3), markings 110*b* that can be seen (FIG. 4), or bumps 110*c* that can be felt by the user and attached to surface 104 through adhesive or another coupler (FIGS. 5 and 6). FIG. 1 shows a first indentation 112 in the surface 104 for selectively receiving at least a part of a user's index finger and a second indentation 114 in the surface 104 for selectively receiving at least a part of a user's thumb.

An imaginary center axis (not shown) extends from the handle end 102*a* to the contact end 102*b*, and the first indentation 112 extends generally parallel to the imaginary center axis. In accord with the embodiment of FIG. 1, the first indentation 112 is offset from the imaginary center axis by no more than thirty degrees; the second indentation 114 extends generally linearly in a direction that is offset from the imaginary center axis between thirty and ninety degrees. It should be appreciated that that indentations 112, 114 may be somewhat curved (i.e., not perfectly linear) in some embodiments, perfectly linear in some embodiments, and extremely curved in some embodiments. It should also be appreciated that the embodiments shown throughout the accompanying figures are intended for a right-handed batter, but that a left-handed batter could potentially use the bat 100 as shown, and/or the indentations 112, 114 may extend as described above in a configuration that is different from that shown in the accompanying figures by being mirrored about the imaginary axis.

The first and second indentations 112, 114 overlap in FIG. 1, which may allow a user to quickly locate both indentations 112, 114 and comfortably place at least part of his index finger in the first indentation 112 and at least part of his thumb in the second indentation 114. More particularly, the first indentation 112 has a handle end 112*a* and a contact end 112*b*; the handle end 112*a* is closer than the contact end 112*b* to the shaft handle end 102*a*. The second indentation 114 has a handle end 114*a* and a contact end 114*b*; the handle end 114*a* is closer than the contact end 114*b* to the shaft handle end 102*a*. The first indentation handle end 112*a* and the second indentation handle end 114*a* are shown to overlap in FIG. 1. It should be appreciated, however, that the first and second indentations 112, 114 may not overlap in various embodiments, and that they may alternately overlap in configurations different from that described above.

Figure 2:
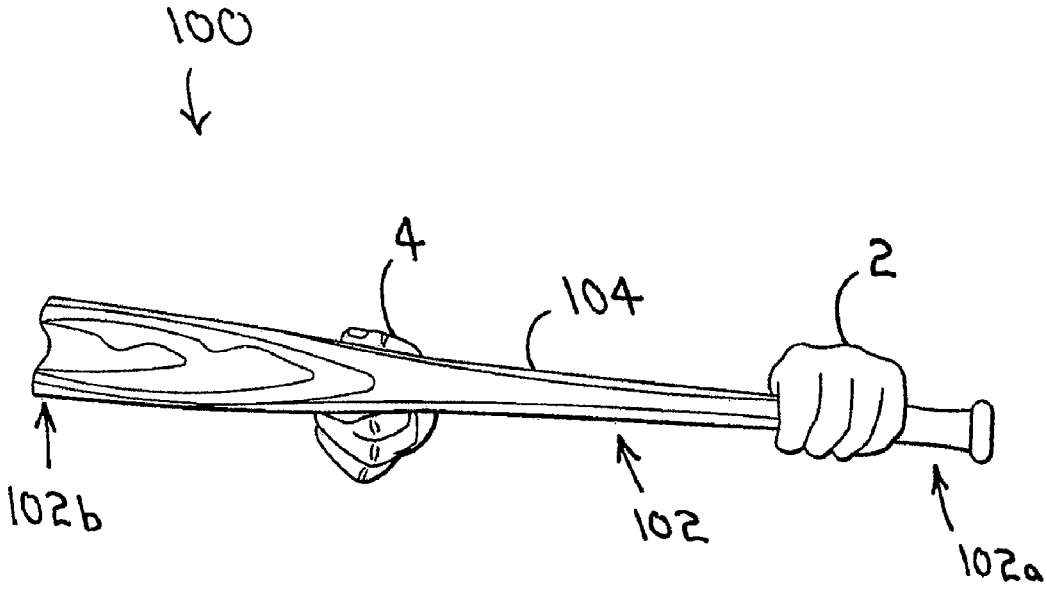
FIG. 2 shows one view of the bunting bat of FIG. 1 being held in a manner.

An imaginary plane passes through the imaginary center axis and divides the elongate shaft 102 into two halves; one half is shown in FIG. 1, and one half is shown in FIG. 2. As also shown in FIG. 1, first and second indentations 112, 114 are entirely contained in one of the halves of the elongate shaft 102. Further, the first and second indentations 112, 114 are shown to be located in a region of the elongate shaft 102 that extends from a point located one-third (⅓) of the shaft length 105 from the handle end 102*a* to a point located one-third (⅓) of the shaft length 105 from the contact end 102*b*. While not presently preferred, the first and second indentations 112, 114 could be located in other regions according to various embodiments of the current invention.

Figure 3:
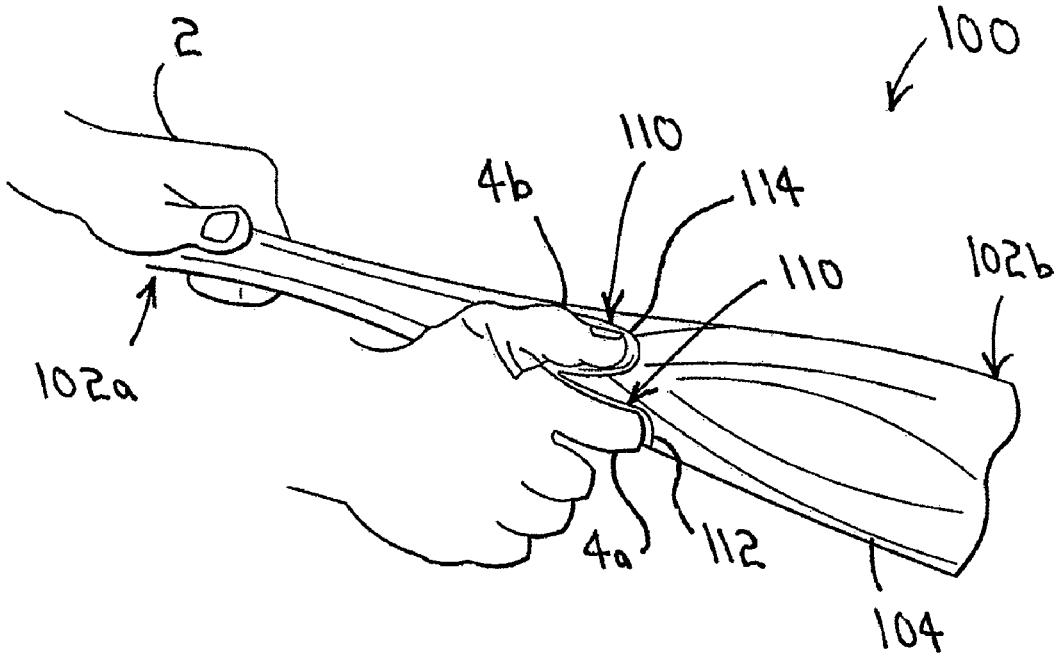
FIG. 3 shows another view of the bunting bat of FIG. 1 being held as in FIG. 2.

FIGS. 2 and 3 show an exemplary method of using the bat 100 shown in FIG. 1. A user's left hand 2 is shown holding the handle end 102*a* of the elongate shaft 102, and the user's right hand 4 is shown holding the elongate shaft 102 at the indicators 110. As best shown in FIG. 3, the index finger 4*a* of the right hand 4 is at least partially placed in the first indentation 112, and the thumb 4*b* of the right hand 4 is at least partially placed in the second indentation 114. The indentations 112, 114 allow the user to quickly determine where and how he should hold the bat 100 to bunt. Further, as shown in FIG. 2, because the indicators 110 are entirely contained in one half of the elongate shaft 102 as described above, the user's fingers are not exposed to an incoming pitch when the user presents the bat 100 to bunt. Also, should the user decide not to bunt, the half of the elongate shaft 102 that does not include the indicators 110 (i.e., the half shown in FIG. 2) may be used to hit an incoming pitch. Because the bat 100 is held as shown (in accordance with the indicators 110,) the user's fingers will not be pinched between the bat 100 and a pitched ball or between the bat 100 and other parts of the user's hand when bunting.

Figure 4:
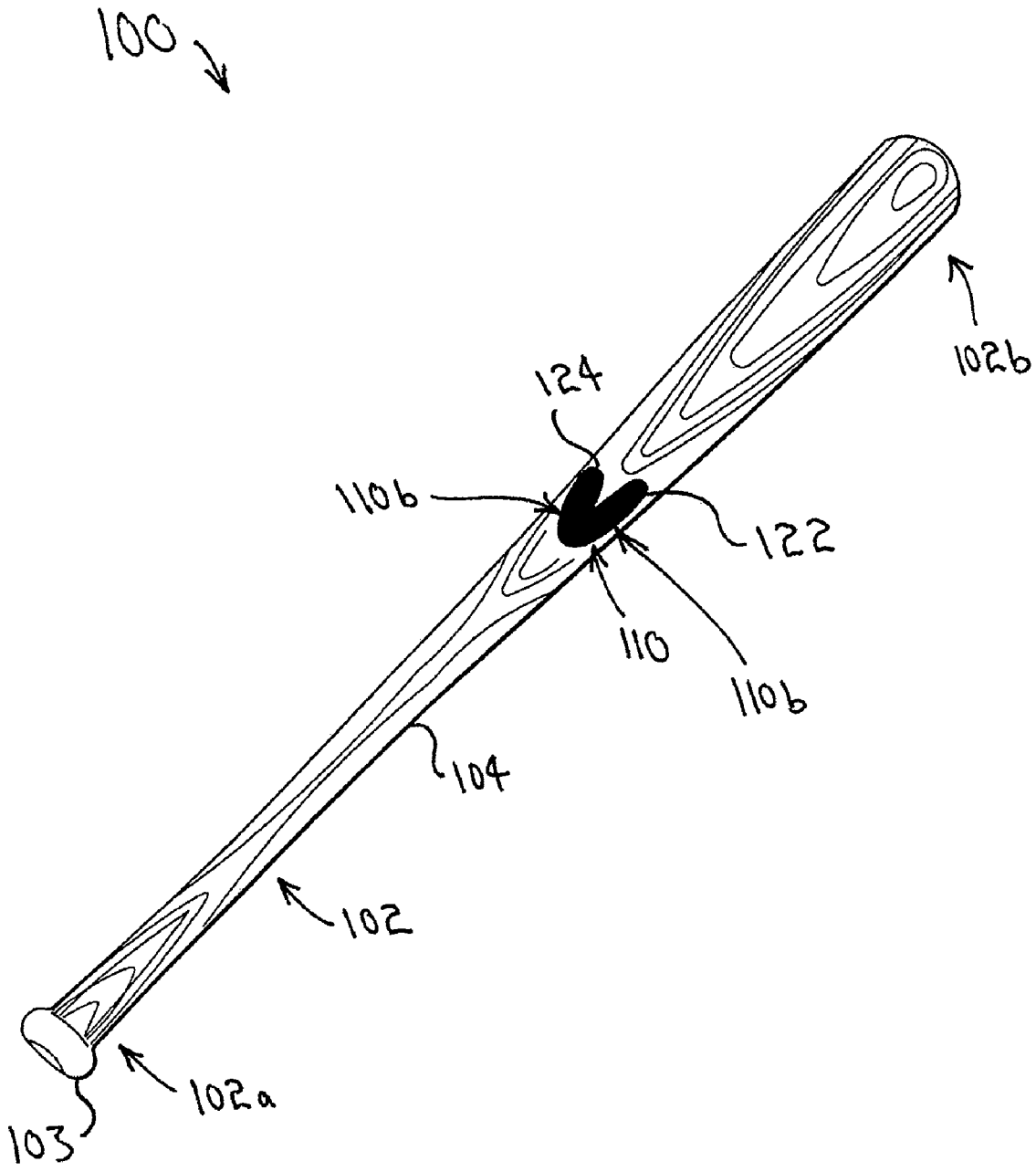
FIG. 4 shows a bunting bat having markings.

FIG. 4 shows a bat 100 having markings 110*b*. The markings 110*b* may be painted on the surface 104, attached to the surface 104 (e.g., by an adhesive), or incorporated through another appropriate manner. Similar to the indentations 110*a* described above, there may be a first marking 122 for indicating proper placement of a user's index finger and a second marking 124 for indicating proper placement of a user's thumb. The first marking 122 may extend generally parallel to the imaginary center axis discussed above, and in accord with the embodiment of FIG. 4, the first marking 122 is offset from the imaginary center axis by no more than thirty degrees; the second marking 124 extends generally linearly in a direction that is offset from the imaginary center axis between thirty and ninety degrees. It should be appreciated that the markings 122, 124 may be somewhat curved (i.e., not perfectly linear) in some embodiments, perfectly linear in some embodiments, and extremely curved in some embodiments. It should also be appreciated that the embodiment shown in FIG. 4 is intended for a right-handed batter, but that a left-handed batter could potentially use the bat 100 as shown, and/or the markings 122, 124 may extend as described above in a configuration that is different from that shown in FIG. 4 by being mirrored about the imaginary axis.

The first and second markings 122, 124 overlap in FIG. 4. It should be appreciated, however, that the first and second markings 122, 124 may not overlap in various embodiments, and that they may alternately overlap in configurations different from that shown in FIG. 4. As above, the first and second markings 122, 124 are entirely contained in one of the halves of the elongate shaft 102. Further, the first and second markings 122, 124 are shown to be located in a region of the elongate shaft 102 that extends from a point located one-third (⅓) of the shaft length 105 from the handle end 102*a* to a point located one-third (⅓) of the shaft length 105 from the contact end 102*b*. While not presently preferred, the first and second markings 122, 124 could be located in other regions according to various embodiments of the current invention.

In an exemplary method of using the bat 100 shown in FIG. 4, a user's left hand 2 may hold the handle end 102*a* of the elongate shaft 102, and the user's right hand 4 may hold the elongate shaft 102 at the indicators 110. The index finger 4*a* of the right hand 4 (FIG. 3) is at least partially placed at the first marking 122, and the thumb 4*b* of the right hand 4 (FIG. 3) is at least partially placed at the second marking 124. The markings 122, 124 allow the user to quickly determine where and how he should hold the bat 100 to bunt. Further, because the indicators 110 are entirely contained in one half of the elongate shaft 102 as described above, the user's fingers are not exposed to an incoming pitch when the user presents the bat 100 to bunt. Because the bat 100 is held as shown (in accordance with the indicators 110,) the user's fingers will not be pinched between the bat 100 and a pitched ball or between the bat 100 and other parts of the user's hand when bunting.

FIGS. 5 and 6 show a bat 100 having bumps 110*c*. The bumps 110*c* may be integrally formed on the surface 104, attached to the surface 104 (e.g., by an adhesive or another coupler), or incorporated through another appropriate manner. Similar to the indentations 110*a* described above, there may be a first bump 132 for indicating proper placement of a user's index finger and a second bump 134 for indicating proper placement of a user's thumb. The first and second bumps 132, 134 may be substantially uninterrupted (FIG. 6), or the first and second bumps 132, 134 may be comprised of a plurality of smaller discrete bumps 132*a*, 134*a* (FIG. 5). The first bump 132 may extend generally parallel to the imaginary center axis discussed above, and in accord with the embodiments of FIGS. 5 and 6, the first bump 132 is offset from the imaginary center axis by no more than thirty degrees; the second bump 134 extends generally linearly in a direction that is offset from the imaginary center axis between thirty and ninety degrees. It should be appreciated that the bumps 132, 134 may be somewhat curved (i.e., not perfectly linear) in some embodiments, perfectly linear in some embodiments, and extremely curved in some embodiments. It should also be appreciated that the embodiments shown in FIGS. 5 and 6 are intended for a right-handed batter, but that a left-handed batter could potentially use the bats 100 as shown, and/or the bumps 132, 134 may extend as described above in a configuration that is different from that shown in FIGS. 5 and 6 by being mirrored about the imaginary axis.

The first and second bumps 132, 134 do not overlap in FIGS. 5 and 6. It should be appreciated, however, that the first and second bumps 132, 134 may overlap in various embodiments. As above, the first and second bumps 132, 134 are entirely contained in one of the halves of the elongate shaft 102. Further, the first and second bumps 132, 134 are shown to be located in a region of the elongate shaft 102 that extends from a point located one-third (⅓) of the shaft length 105 from the handle end 102*a* to a point located one-third (⅓) of the shaft length 105 from the contact end 102*b*. While not presently preferred, the first and second bumps 132, 134 could be located in other regions according to various embodiments of the current invention.

In an exemplary method of using the bats 100 shown in FIGS. 5 and 6, a user's left hand 2 may hold the handle end 102*a* of the elongate shaft 102, and the user's right hand 4 may hold the elongate shaft 102 at the indicators 110. The index finger 4*a* of the right hand 4 (FIG. 3) is at least partially placed at the first bump 132, and the thumb 4*b* of the right hand 4 (FIG. 3) is at least partially placed at the second bump 134. The bumps 132, 134 allow the user to quickly determine where and how he should hold the bat 100 to bunt. Further, because the indicators 110 are entirely contained in one half of the elongate shaft 102 as described above, the user's fingers are not exposed to an incoming pitch when the user presents the bat 100 to bunt. Because the bat 100 is held as shown (in accordance with the indicators 110,) the user's fingers will not be pinched between the bat 100 and a pitched ball or between the bat 100 and other parts of the user's hand when bunting.

Those skilled in the art appreciate that variations from the specified embodiments disclosed above are contemplated herein and that the described embodiments are not limiting. The description should not be restricted to the above embodiments, but should be measured by the following claims.

What is claimed is:

1. A bat, comprising:

a rounded elongate shaft having a handle end and a contact end, the handle end having a diameter that is smaller than a diameter of the contact end, the rounded elongate shaft presenting a generally smooth surface capable of contacting a ball; and at least one grip designator between the handle and contact ends to designate where and how a user should hold the bat while bunting;

wherein each grip designator consists of:

a first bump extending from the generally smooth surface; and a second bump extending from the generally smooth surface;

wherein an imaginary center axis extends from the handle end to the contact end;

wherein the first bump extends generally linearly in a direction that is offset from the axis by no more than thirty degrees; and wherein the second bump extends generally linearly in a direction that is offset from the axis between thirty and ninety degrees.

2. The bat of claim 1, wherein:

the first bump comprises a plurality of smaller discrete bumps; and the second bump comprises a plurality of smaller discrete bumps.

3. The bat of claim 2, wherein the first and second bumps do not overlap.

4. The bat of claim 1, wherein the first and second bumps do not overlap.

5. The bat of claim 1, wherein the first bump is integrally formed with the generally smooth surface and the second bump is integrally formed with the generally smooth surface.

6. The bat of claim 1, wherein the first bump is attached to the generally smooth surface and the second bump is attached to the generally smooth surface.

7. The bat of claim 1, wherein:

the imaginary center axis extending from the handle end to the contact end passes through an imaginary plane in at least two points such that the imaginary plane separates the rounded elongate shaft into a first half and a second half; and the first and second bumps are entirely contained in the first half.

8. The bat of claim 7, wherein:

the elongate shaft has three consecutive and generally equilength regions that collectively extend from the handle end to the contact end; and the first and second bumps are entirely contained in the middle region.

9. The bat of claim 1, wherein:

the elongate shaft has three consecutive and generally equilength regions that collectively extend from the handle end to the contact end; and the first and second bumps are entirely contained in the middle region.

10. The bat of claim 1, wherein the elongate shaft is constructed of wood, metal, plastic, composite, and/or another material.

* * * * *